US010215418B2

(12) United States Patent
Metternich et al.

(10) Patent No.: US 10,215,418 B2
(45) Date of Patent: Feb. 26, 2019

(54) SEALING DEVICE FOR A GAS TURBINE COMBUSTOR

(71) Applicant: ANSALDO ENERGIA IP UK LIMITED, London (GB)

(72) Inventors: Jeremy Metternich, Wellington, FL (US); Stephen W. Jorgensen, Palm City, FL (US); David Giel, Jupiter, FL (US); Ramesh Keshava-Bhattu, Jupiter, FL (US)

(73) Assignee: ANSALDO ENERGIA IP UK LIMITED (GB)

( * ) Notice: Subject to any disclaimer, the term of this patent is extended or adjusted under 35 U.S.C. 154(b) by 695 days.

(21) Appl. No.: 14/512,633

(22) Filed: Oct. 13, 2014

(65) Prior Publication Data

US 2016/0102864 A1 Apr. 14, 2016

(51) Int. Cl.

| | |
|---|---|
| ***F23R 3/60*** | (2006.01) |
| ***F23R 3/02*** | (2006.01) |
| ***F23R 3/00*** | (2006.01) |
| ***F23R 3/26*** | (2006.01) |
| ***F23R 3/08*** | (2006.01) |
| ***F23R 3/10*** | (2006.01) |
| ***F23R 3/04*** | (2006.01) |

(Continued)

(52) U.S. Cl.

CPC ..... *F23R 3/60* (2013.01); *F01D 9/023* (2013.01); *F23R 3/002* (2013.01); *F23R 3/02* (2013.01); *F23R 3/04* (2013.01); *F23R 3/08* (2013.01); *F23R 3/10* (2013.01); *F23R 3/26* (2013.01); *F23R 3/46* (2013.01); *F05D 2240/55* (2013.01); *F05D 2240/57* (2013.01); *F23R 2900/00012* (2013.01); *F23R 2900/03042* (2013.01); *F23R 2900/03043* (2013.01); *F23R 2900/03044* (2013.01)

(58) Field of Classification Search

CPC .... F23R 3/002; F23R 3/02; F23R 3/04; F23R 3/08; F23R 3/10; F23R 3/26; F23R 3/60; F23R 2900/00012; F23R 2900/03043; F23R 2900/03044; F05D 2240/55; F05D 2240/57; F01D 9/023

See application file for complete search history.

(56) References Cited

U.S. PATENT DOCUMENTS 4,362,500 A * 12/1982 Eriksson ..... F26B 23/022 110/212
4,413,470 A * 11/1983 Scheihing ..... F23R 3/60 60/800

(Continued)

OTHER PUBLICATIONS

International Search Report with Written Opinion dated Jan. 8, 2016 in PCT Application No. PCT/US2015/055331, 10 pages.

(Continued)

*Primary Examiner* — Scott J Walthour
(74) *Attorney, Agent, or Firm* — Hovey Williams LLP

(57) ABSTRACT

The present invention discloses a novel apparatus and way for sealing a portion of a gas turbine combustor in order to regulate the flow of compressed air into an annular passage adjacent to a combustion liner. A compressible seal is utilized having a first annular portion, a second annular portion, and a transition portion, the compressible seal regulates airflow passing through the compressible seal via a plurality of openings and/or axially extending slots.

13 Claims, 13 Drawing Sheets

(51) Int. Cl.
*F23R 3/46* (2006.01)
*F01D 9/02* (2006.01)

(56) References Cited

U.S. PATENT DOCUMENTS 4,413,477 A 11/1983 Dean et al.
5,987,879 A 11/1999 Ono
7,707,835 B2 5/2010 Lipinski et al.
8,276,391 B2 10/2012 Berry et al.
8,307,657 B2 11/2012 Chila
8,490,400 B2 7/2013 Koenig et al.
8,516,822 B2 8/2013 Chen et al.
2001/0032453 A1* 10/2001 Tatsumi ..... F23R 3/007 60/796
2005/0050902 A1* 3/2005 Anichini ..... F23M 5/04 60/800
2005/0132708 A1* 6/2005 Martling ..... F01D 9/023 60/752
2005/0262845 A1 12/2005 Martling et al.
2006/0242964 A1* 11/2006 Parker ..... F01D 9/023 60/796
2007/0012043 A1* 1/2007 Parker ..... F23R 3/44 60/752
2007/0130958 A1* 6/2007 Ohri ..... F23R 3/60 60/796
2007/0256417 A1* 11/2007 Parker ..... F23M 5/00 60/748
2007/0258808 A1* 11/2007 Ohri ..... F01D 9/023 415/139
2008/0155988 A1* 7/2008 Commaret ..... F23R 3/04 60/755
2010/0005803 A1* 1/2010 Tu ..... F01D 9/023 60/752
2010/0064693 A1* 3/2010 Koenig ..... F01D 9/023 60/760
2010/0102144 A1* 4/2010 Conete ..... F01D 25/243 239/265.11
2010/0154426 A1* 6/2010 Parker ..... F23R 3/002 60/748
2011/0023496 A1* 2/2011 Bastnagel ..... F23R 3/002 60/752
2011/0252805 A1 10/2011 Berry et al.
2012/0036858 A1* 2/2012 Lacy ..... F23R 3/002 60/754
2012/0304657 A1* 12/2012 Melton ..... F23R 3/60 60/752
2014/0183825 A1 7/2014 Chuong et al.
2014/0238029 A1* 8/2014 Sutcu ..... F23R 3/10 60/754
2015/0354386 A1* 12/2015 Chuong ..... F01D 25/30 415/182.1

OTHER PUBLICATIONS

Extended European Search Report from Corresponding Application EP 15850671.7 dated Jul. 13, 2018 (8 pages).

* cited by examiner

SEALING DEVICE FOR A GAS TURBINE COMBUSTOR

CROSS-REFERENCE TO RELATED APPLICATIONS

Not applicable.

TECHNICAL FIELD

The present invention relates generally to an apparatus and method for sealing an aft region of a gas turbine combustor. More specifically, the present invention provides an apparatus and method for controlling the amount of compressed air passed to a combustor for cooling and for mixing prior to injection in the combustion liner.

BACKGROUND OF THE INVENTION

In an effort to reduce the amount of pollution emissions from gas-powered turbines, governmental agencies have enacted numerous regulations requiring reductions in the amount of oxides of nitrogen (NOx) and carbon monoxide (CO). Lower combustion emissions can often be attributed to a more efficient air distribution control process, with specific regard to fuel injector location, airflow rates, and mixing effectiveness.

Early combustion systems utilized diffusion type nozzles, where fuel is mixed with air external to the fuel nozzle by diffusion, proximate the flame zone. Diffusion type nozzles historically produce relatively high emissions due to the fact that the fuel and air burn essentially upon interaction, without mixing, and stoichiometrically at high temperature to maintain adequate combustor stability and low combustion dynamics.

An alternate means of premixing fuel and air and obtaining lower emissions can occur by utilizing multiple combustion stages. In order to provide a combustor with multiple stages of combustion, the fuel and air, which mix and burn to form the hot combustion gases, must also be staged. By controlling the amount of fuel and air passing into the combustion system, available power as well as emissions can be controlled. Fuel can be staged through a series of valves within the fuel system or dedicated fuel circuits to specific fuel injectors. Air, however, can be more difficult to stage given the large quantity of air supplied by the engine compressor.

Of importance to the operation of a combustion system is also regulating the amount of compressed air supplied to the combustion system for mixing and reacting with fuel and as providing a source of cooling air. Therefore, it is necessary to carefully control the distribution of compressed air entering the combustion system. A number of modern day gas turbine combustion systems include a flow sleeve encompassing a combustion liner, where the flow sleeve can at least partially regulate the amount of air entering the combustion system. One such combustion system 100 is shown in FIGS. 1 and 2. The combustion system 100 has a flow sleeve 102 encompassing a combustion liner 104. Air for cooling of the combustion liner 104 and for use in the combustion process is enters a channel 106 through a plurality of holes 108 and an open flow sleeve aft end 110. Such an arrangement has little way of controlling the amount of cooling air entering the passageway 106.

Referring now to FIG. 3, an alternate prior art combustion system 300 for controlling the flow of compressed air to the passageway 326 between the flow sleeve 302 and combustion liner 304 is depicted. In such an arrangement, the sealing interface between the combustion liner 304 and flow sleeve 302 is accomplished by a piston ring 308. The piston ring 308 has a cross sectional area sized to provide the proper preload to ensure sealing. However, this proper preload requires a large radial area to implement. Such radial area requirements can create implementation problems in addition to flow blockage issues due to their mere size. As a result, the flow blockages that can occur increase the pressure drop taken across this air inlet region, adversely affecting the performance of the combustion system. In addition, the sealing system performance of a piston ring is directly tied to the roundness of the sealing interface.

SUMMARY

The present invention discloses an apparatus and method for regulating compressed air supply to a combustion system. More specifically, in an embodiment of the present invention, a sealing system for a gas turbine combustor is disclosed. The sealing system comprises a combustion liner located along an axis of a gas turbine combustor and a flow sleeve positioned radially outward of the combustion liner so as to form an annular passage between the combustion liner and the flow sleeve. The sealing system also comprises a compressible seal having a first annular portion, a second annular portion, and a transition portion therebetween. The seal is positioned between the flow sleeve and the combustion liner and includes a plurality of openings for regulating the amount of compressed air that can pass through the seal.

In an alternate embodiment of the present invention, a seal for a gas turbine combustor is disclosed. The seal comprises a first annular portion having a first diameter and a second annular portion having a second diameter, where the second annular portion is radially outward of the first annular portion. The seal also includes a transition portion extending between the first annular portion and the second annular portion, where the transition portion has a plurality of openings for regulating a flow of cooling fluid.

In yet another embodiment of the present invention, a method of regulating cooling fluid flow to a gas turbine combustor is disclosed. More specifically, the method comprises providing a seal extending between a combustion liner and a flow sleeve where the seal has a plurality of slots and a plurality of openings. A cooling fluid is directed across the seal with the seal permitting a predetermined amount of air to enter a passageway located between the combustion liner and the flow sleeve.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

Figure 1:
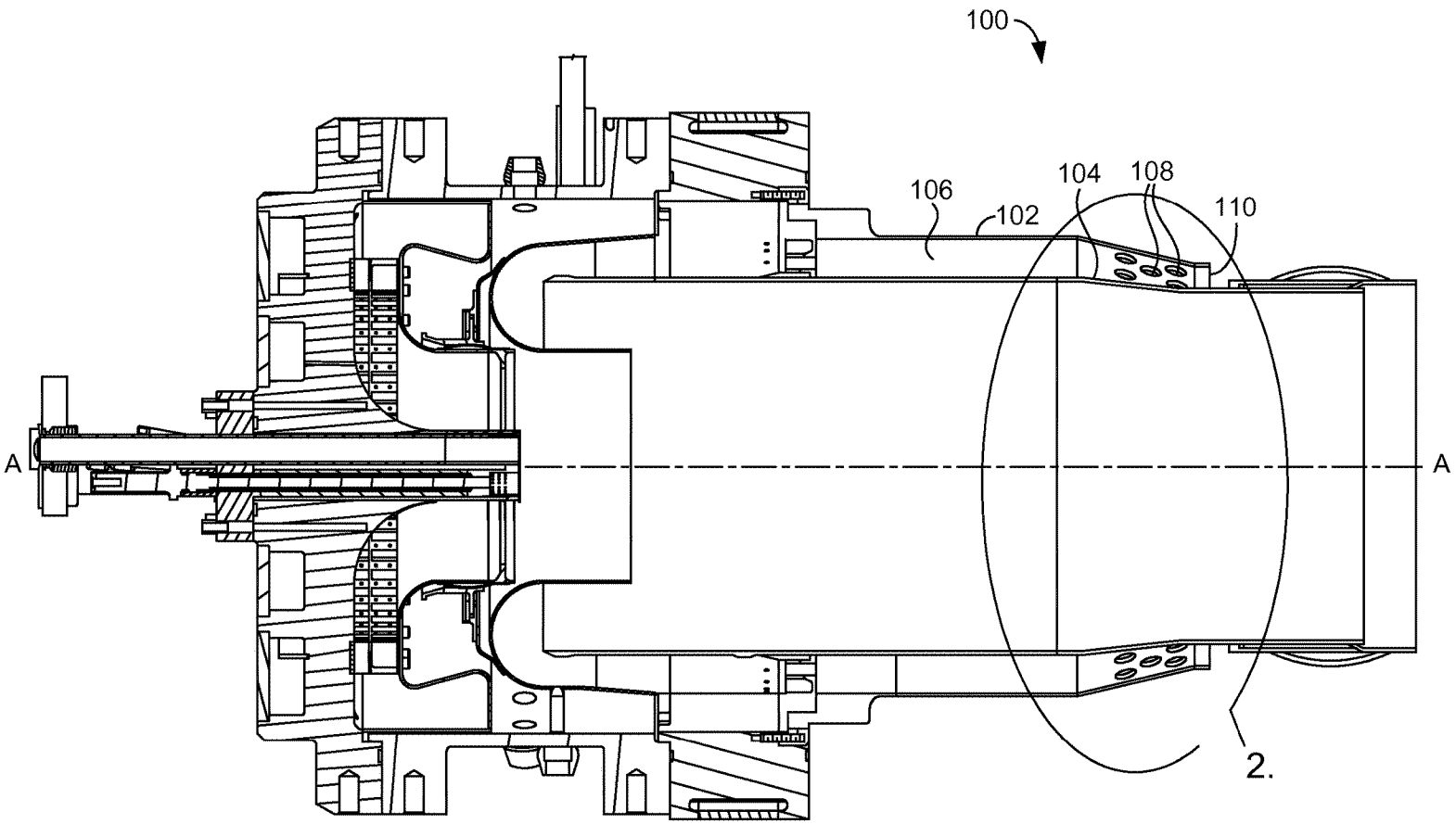
FIG. 1. PRIOR ART
FIG. 1 is a cross section of a combustion system sealing arrangement of the prior art.

The present invention discloses a system and method for regulating the flow of compressed air to a combustion system. The present invention is shown in detail in FIGS. 4-9. Referring initially to FIGS. 4-8, a sealing system 400 for use in a gas turbine combustor is shown. The sealing system 400 comprises a combustion liner 402 positioned along a center axis A-A of a gas turbine combustor 404 and also includes a flow sleeve 406 positioned radially outward of the combustion liner 402, thereby forming an annular passage 408 between the combustion liner 402 and the flow sleeve 406. The sealing system 400 also comprises a compressible seal 410 positioned between the combustion liner 402 and the flow sleeve 406. The compressible seal 410 is shown in more detail in FIGS. 5, 6, and 8, and has a first annular portion 412, a second annular portion 414, and a transition portion 416. As will be discussed in further detail below, the compressible seal 410 regulates an airflow passing through the seal 410 and into the annular passage 408.

Figure 2:
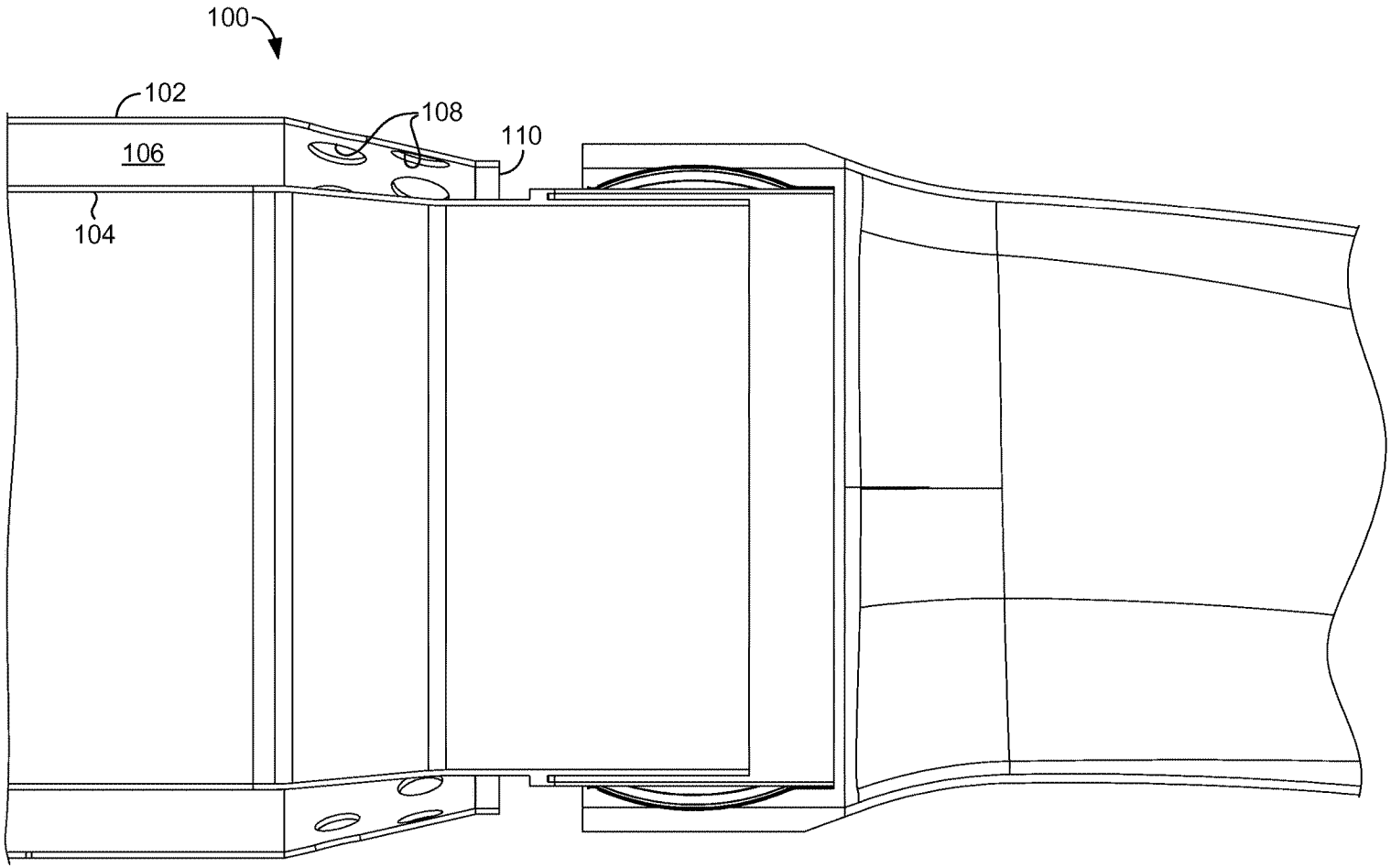
FIG. 2. PRIOR ART
FIG. 2 is a detailed cross section of a portion of the combustion system of FIG. 1.
Figure 3:
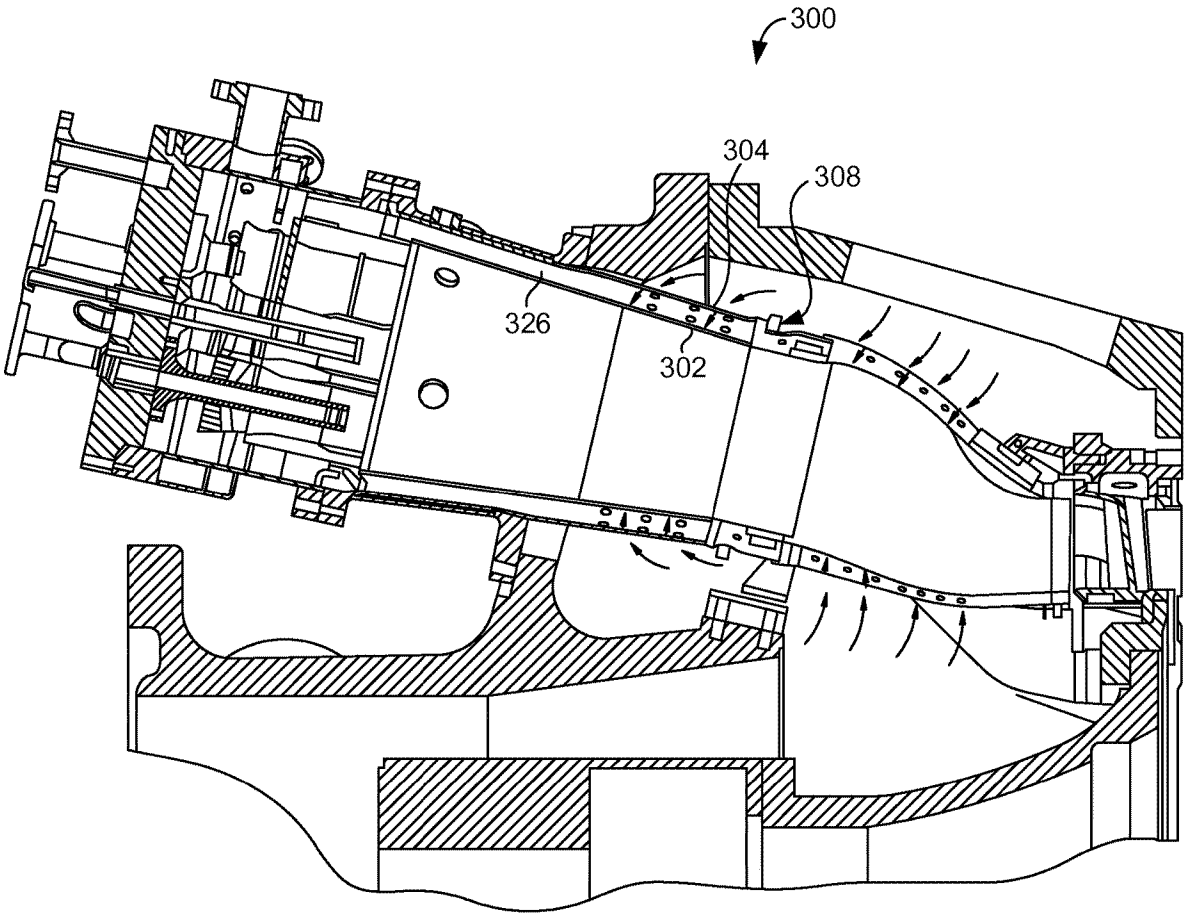
FIG. 3. PRIOR ART
FIG. 3 is a cross section of a portion of an alternate combustion system sealing arrangement in accordance with the prior art.

The compressible seal 410 serves to regulate airflow passing therethrough for cooling of combustion liner 402 and then into the combustion liner 402 for mixing with fuel. The compressible seal 410 provides a way of regulating the amount of cooling air permitted to pass into the annular passage 408 between the flow sleeve 406 and combustion liner 402. In some prior art combustion systems, as shown in FIGS. 1-3, there was no type of flow restriction device used to regulate the air flow. Instead, air flow was regulated by the overall opening or distance between the combustion liner and flow sleeve. Further, performance of a seal in prior art combustion systems was directly related to the roundness of the sealing interface. The compressible seal provides a more forgiving interface which accommodates out of round mating surfaces.

Referring back to FIG. 8, the compressible seal 410 is fixedly secured to an annular ring 413 located proximate an aft end 418 of the combustion liner 402 at the first annular portion 412. The first diameter D1 of the first annular portion 412 is sized to be slightly larger than the diameter of the annular ring 413 so as to slide into place over the annular ring 413 to facilitate it being secured to the annular ring 413. The compressible seal 410 is preferably secured to the annular ring 413 by a weld, such as a stitch weld or plug weld, or other acceptable weld type. Alternatively, the compressible seal 410 may be brazed to the annular ring 413.

The annular ring 413 is positioned about the aft end 418 of the combustion liner 402 and forms a cooling channel 420. The cooling channel 420 is supplied with cooling air through one or more feed holes 422. Cooling air passes through the cooling channel 420 and exits the aft end 418 of the combustion liner 402.

As discussed above, and shown in FIG. 8, the compressible seal 410 also comprises a second annular portion 414 having a second diameter D2, where the second annular portion 414 is located radially outward of the first annular portion 412. The second annular portion 414 is sized so as to interface with an inlet ring 424 of the flow sleeve 406. That is, the inlet ring 424 has an outer diameter OD and an inner diameter ID, where the second diameter D2 of the second annular portion 414 is sized so as to be slightly larger than the inner diameter ID of the inlet ring 424 in its free condition so that the second annular portion 414 of the compressible seal 410 is under a compression fit with the inlet ring 424 of the flow sleeve 406 when the compressible seal 410 is installed in the flow sleeve 406. As the second annular portion 414 is compressed when engaged in the inlet ring 424 and thereby contacts and rubs against the inlet ring 424, to reduce the wear of the seal and inlet ring 424, a hardface coating can be applied to both the second annular portion 414 and the ID portion of the inlet ring 424.

Figure 5:
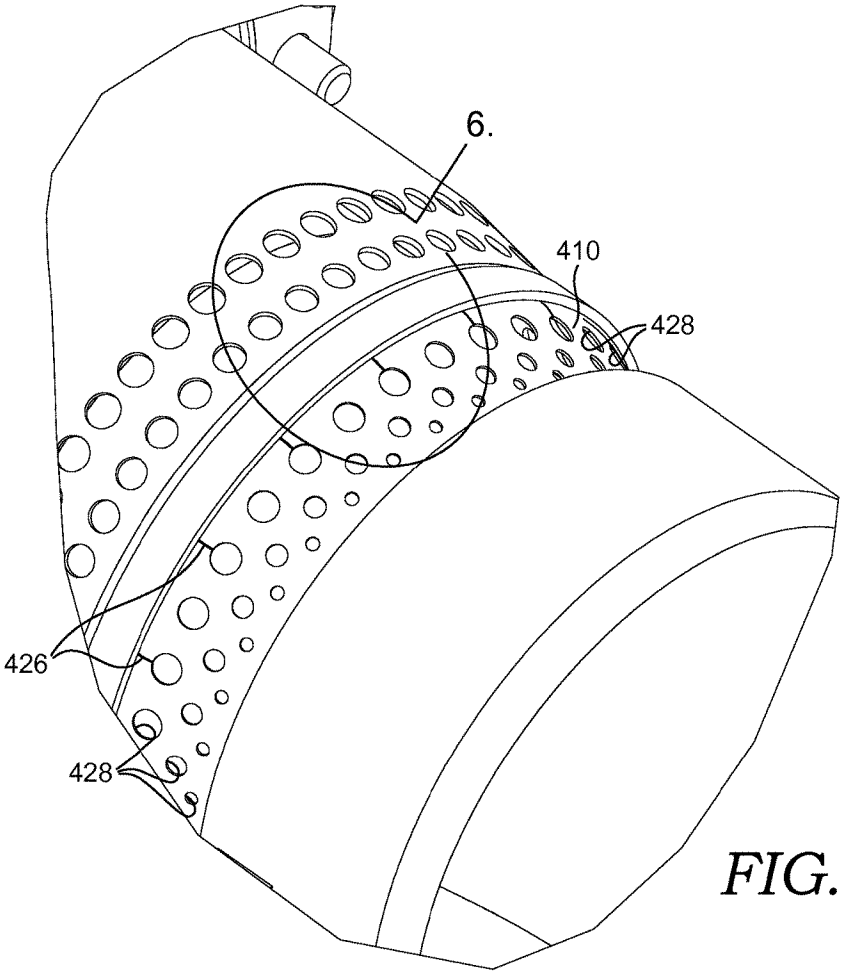
FIG. 5 is a detailed perspective view of a portion of the combustion system of FIG. 4.
Figure 6:
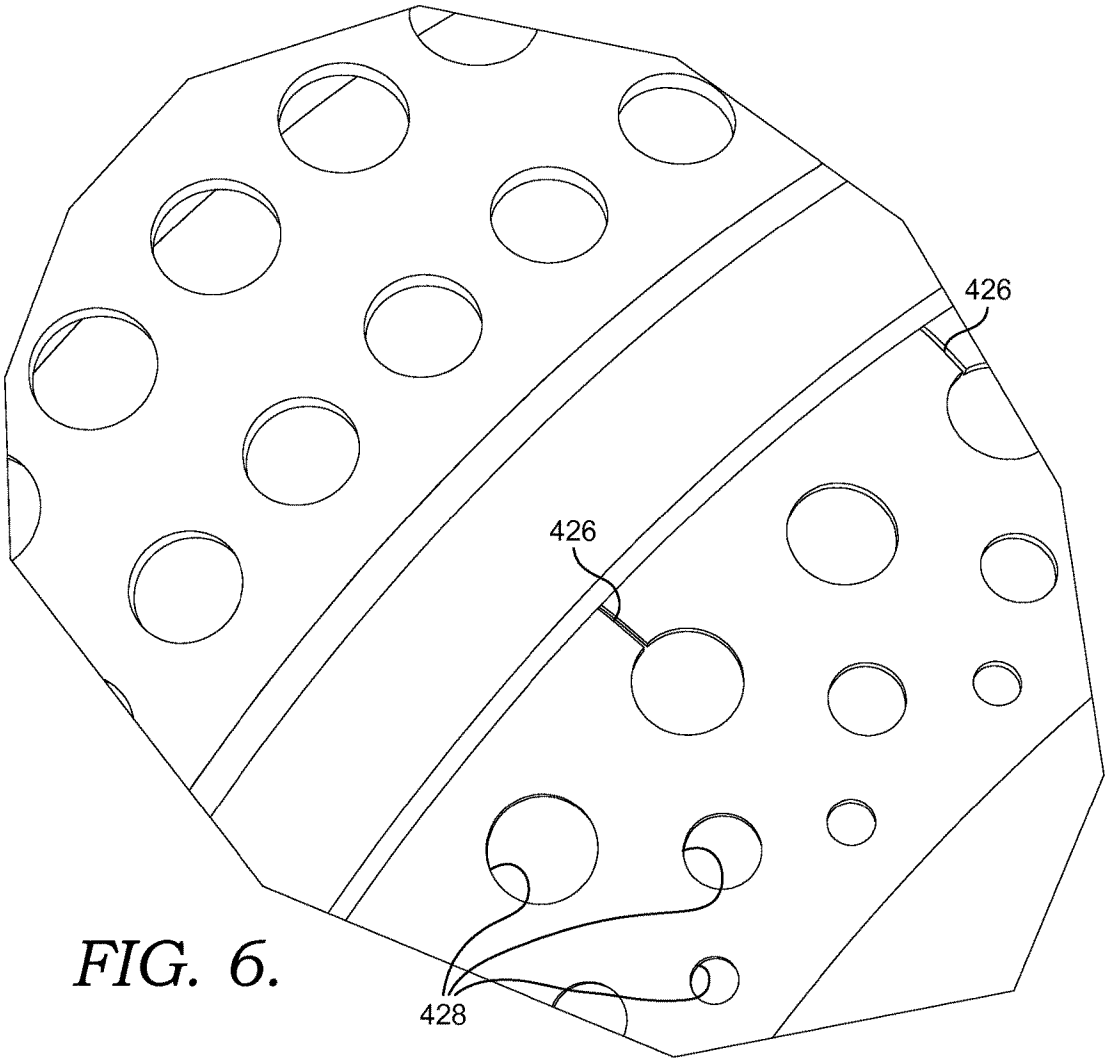
FIG. 6 is a further detailed perspective view of a portion of the combustion system of FIG. 5.
Figure 7:
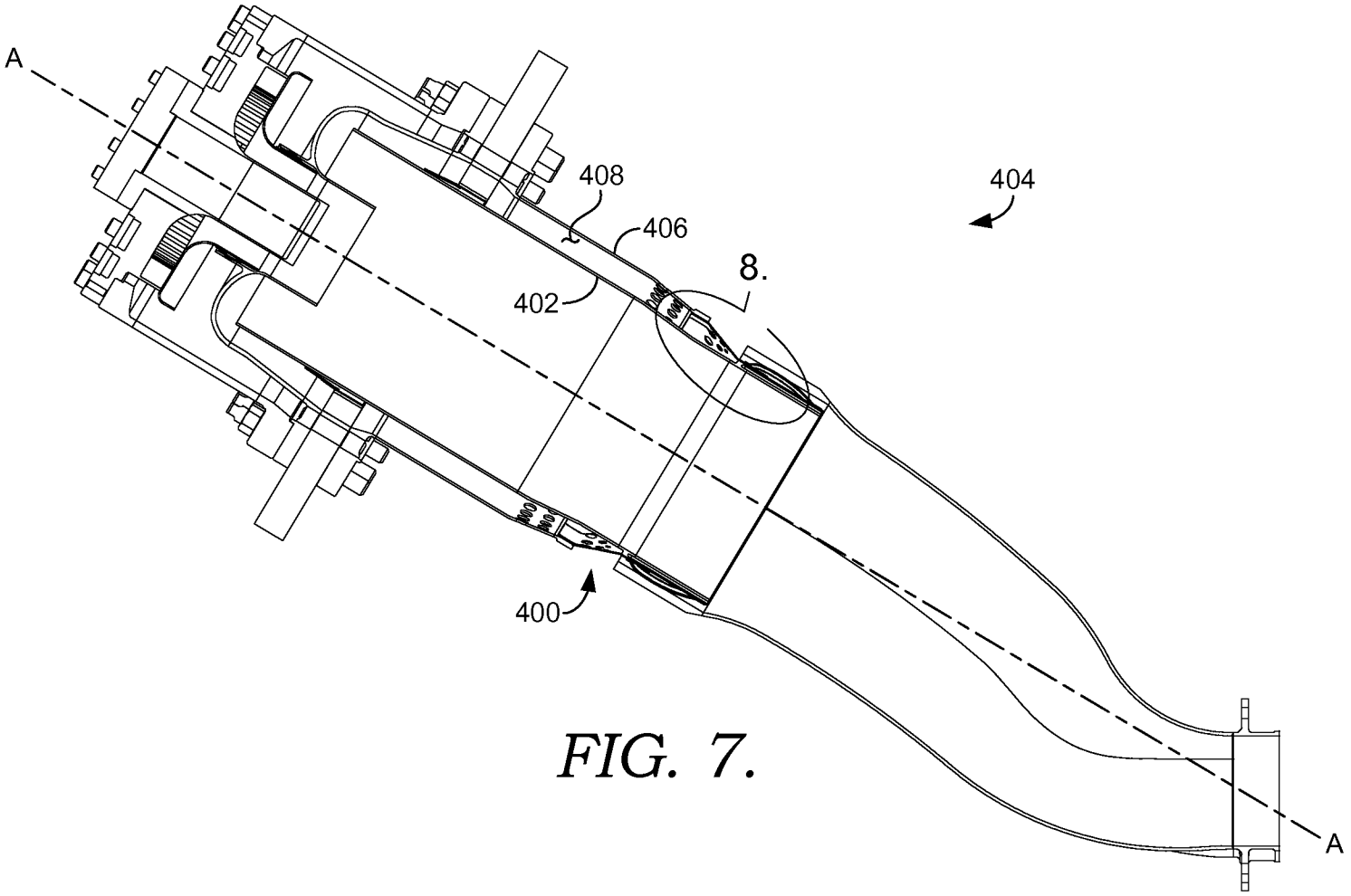
FIG. 7 is a cross section view of a combustion system in accordance with an embodiment of the present invention.
Figure 8:
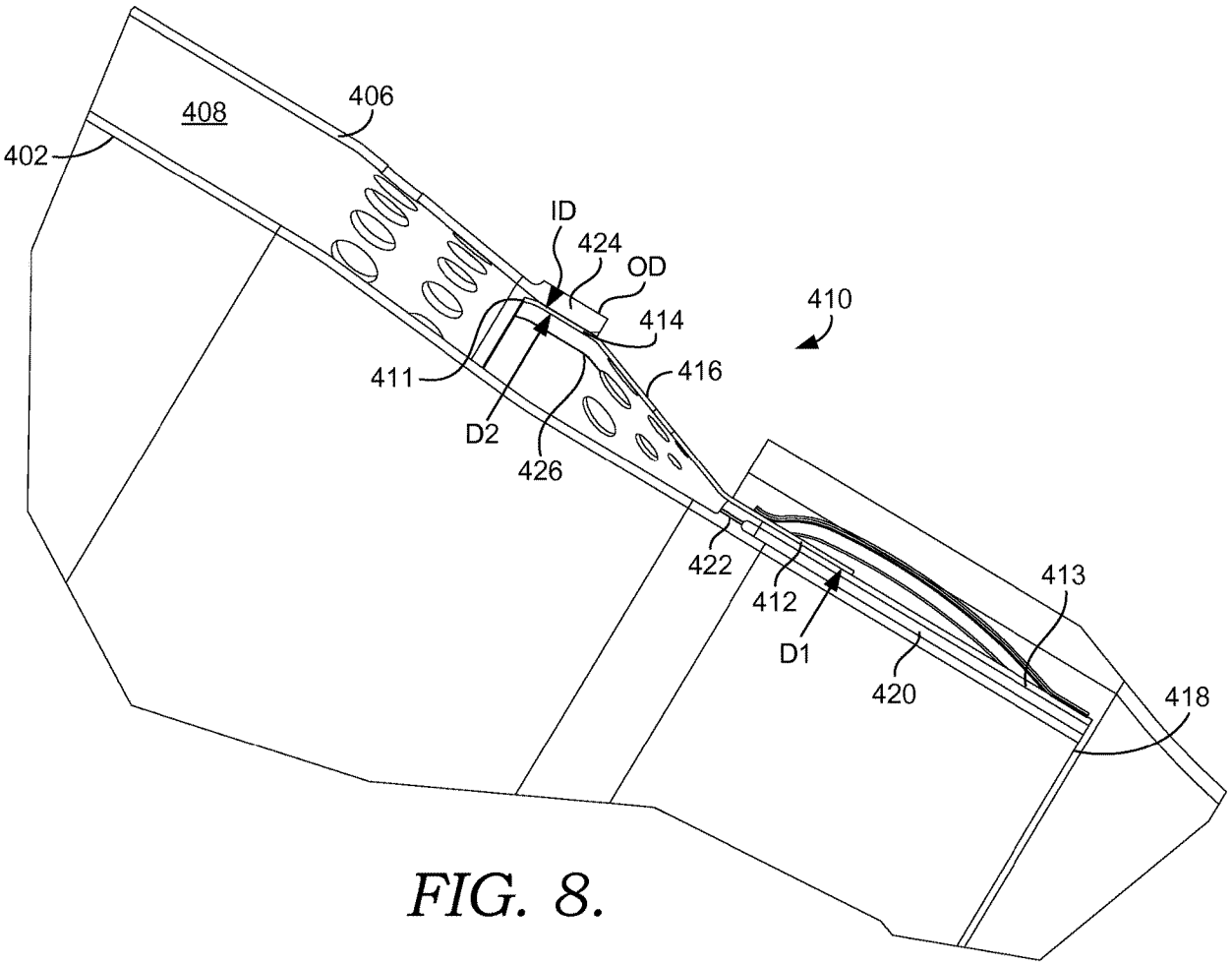
FIG. 8 is a detailed cross section of a portion of the combustion system of FIG. 7.

Referring to FIGS. 5, 6, and 8, the second annular portion 414 also comprises a plurality of axial slots 426 that extend to an aft end 411 of the compressible seal 410, and for the embodiment depicted herein, also extend to the transition portion 416. The plurality of axial slots 426 assist in permitting the compressible seal 410 to compress upon installation in the inlet ring 424. In a representative embodiment of the present invention, eighteen axial slots 426 each have a width of approximately 0.020 inches in a free state. However, as one skilled in the art understands, the exact number of slots and their respective free state width can vary. However, the width of slot 426 needs to be wide enough to allow the seal to compress and seat inside the flow sleeve 406, but also be narrow enough to minimize leakage flow.

Figure 4:
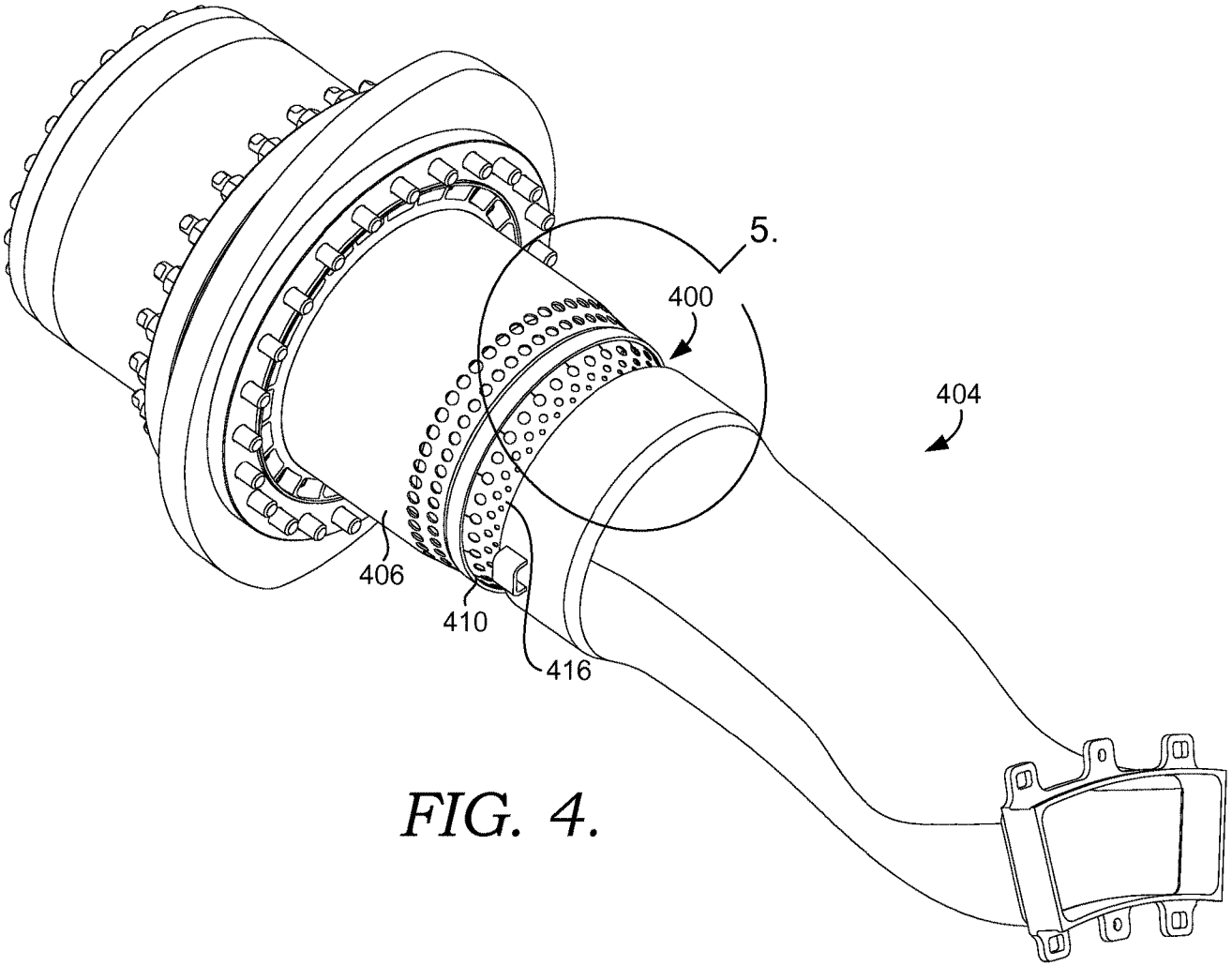
FIG. 4 is a perspective view of a combustion system in accordance with an embodiment of the present invention.

The compressible seal 410 also comprises a transition portion 416 extending between the first annular portion 412 and the second annular portion 414. The transition portion 416 includes a way of regulating airflow passing through the compressible seal 410. More specifically, the transition portion 416 comprises a plurality of openings 428 positioned about the transition portion 416. The plurality of openings 428 can be placed about the transition portion 416 in a variety of ways. Such embodiments include an equal, uniform distribution of openings 428, arranging the openings 428 into a plurality of rows, or a pre-determined pattern of openings 428 to distribute airflow in a pre-determined manner. For example, in an embodiment of the present invention, there are three rows of thirty-six holes in the transition portion 416 along with two rows of holes in the flow sleeve 406, as shown in FIGS. 4-6. This pattern provides air flow through openings 428 and the leakage air through the slots 426 in order to set the amount of airflow provided to the combustion liner 402 to a desired level. The openings 428 are also arranged in a way so as to introduce air as soon as possible to cool the combustion liner 402 while maintaining an acceptable chord length between the openings 428. Furthermore, the openings 428 are staggered to minimize cross-flow effects and ultimately provide uniform flow to the combustion liner 402, as cross flow effects can reduce the effectiveness of cooling air impinging on and cooling the combustion liner 402.

Depending on the embodiment of the compressible seal 410, the plurality of axial slots 426 may or may not intersect with the plurality of rows of openings 428. The openings 428 can be placed in the transition portion 416 through a variety of manners such as punching, EDM, or laser cutting of the transition portion 416. As one skilled in the art understands, the diameter of the openings 428 will vary and is a function of the desired mass flow to combustion liner 402, cooling requirements, and cross flow effects in the annular passage 408.

Depending on the exact fit-up of the compressible seal 410 to the flow sleeve inlet ring 424, the effective area that remains open to permit air flow to pass therethrough can vary. For example, in a nominal fit-up embodiment of the present invention, the total amount of flow area open through the seal is about 0.55% of the total area. However, under a looser fit condition, such as either smaller seal diameter or larger inlet ring 424 diameter, the amount of total flow area (leakage) through the compressible seal can approximately double to 1.11%. The compressible seal 410 is sized such that the second annular portion 414 is preferably oversized by up to 0.020 inches in diameter in order to create an interference fit with the flow sleeve inlet ring 424.

The fit-up of the compressible seal 410 also provides a thermally free structural support for the flow sleeve. The compressible seal 410 provides support that is capable of accommodating out of round mating surfaces without inducing constraint due to thermal growth. More specifically, the structural interaction between the compressible seal and the flow sleeve provides acoustical dampening by resisting the acoustical response of the hardware.

The compressible seal 410 can be fabricated from a variety of materials and methods. For example, the compressible seal 410 is generally fabricated from a single sheet of materials that is cut, rolled, welded and the formed to the desire diameter. Acceptable type seal materials include, but are not limited to, Inconel 718 and Hastelloy X, both nickel-based alloys. For the embodiment depicted, the compressible seal 410 has a thickness of approximately 0.060 inches. However, the seal thickness can be changed to vary the amount of preload applied to the seal 410. Alternatively, other materials can be used, although these materials will have slightly less desirable material properties. The material chosen should have some flexibility or spring to it due to the required compression of the axial slots 426.

Figure 9:
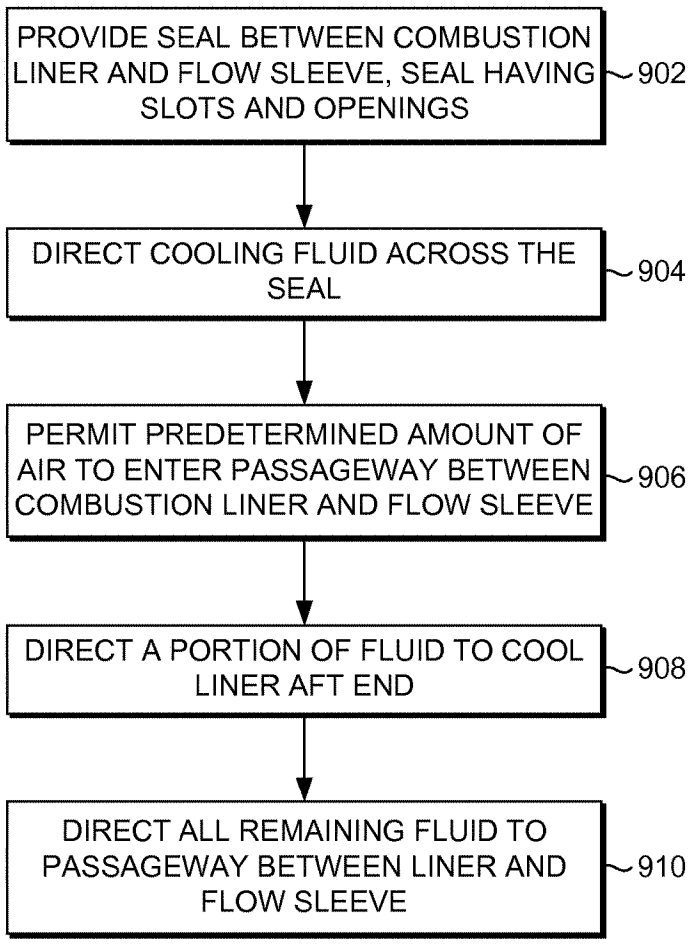
FIG. 9 is a flow diagram depicting an embodiment of the present invention.

Referring now to FIG. 9, a method 900 of regulating cooling fluid flow to a gas turbine combustor is disclosed. The method 900 comprises the step 902 of providing a seal extending between a combustion liner and a flow sleeve, the seal having a plurality of openings in the seal. In the step 904, a cooling fluid, such as air, is directed across the seal. In a step 906, a predetermined amount of air enters a passageway located between the combustion liner and the flow sleeve. Then in a step 908, a portion of the predetermined amount of air is directed to cool an aft end of the combustion liner. In a step 910, all remaining air, or other fluid, passes along an external passage of the combustion liner and is directed towards an inlet end of the combustion liner.

In operation, the compressed air discharges from an engine compressor and is directed into a plenum in which the one or more combustion liners 402 and flow sleeves 406 are located. The compressed air is then drawn in to the combustion system through the plurality of openings 428 in the transition portion 416. The openings 428 are sized to create a desired pressure drop and may be additionally sized to reduce thermal gradients along a combustion liner due to impingement effects on the liner surface. More specifically, for an embodiment of the present invention, the size of each opening 428 is determined based on its relationship with the liner 402. The annulus of each opening 428 is projected onto the surface of the liner 402 with respect to the opening centerline. The downstream surface area of this projection forms the general area available for the flow to exit opening 428. In order to minimize the flow variation due to manufacturing tolerances or misalignment of the liner with respect to the flow sleeve, and ultimately ensure the opening 428 controls the flow, this projection area is approximately 2.5 times the area of each opening 428.

As discussed above, a portion of the compressed air is drawn downstream towards the aft end 418 of the combustion liner 402, into the passageway 420 where it serves to cool the combustion liner aft end 418. However, a majority of the compressed air is directed upstream towards an inlet of the combustion liner 402. This compressed air is directed between the flow sleeve 406 and the combustion liner 402, through the annular passage 408. The compressed air cools the wall of the combustion liner 402 as the air passes upstream towards the inlet end. To aid in enhancing the cooling effectiveness of the compressed air, the combustion liner 402 may also include a plurality of heat transfer devices commonly referred to as trip strips. The heat transfer devices comprise a plurality of raised edges in the combustion liner wall, the raised edges extending into the flow of compressed air, so as to cause the flow to trip, thereby enhancing the heat transfer effectiveness of the compressed air.

In order to minimize the wear on the flow sleeve inlet ring 424 and the compressed seal 410, the second annular portion 414 of the compressible seal 410 and the inner diameter region of the flow sleeve inlet ring 424 can each have a wear reduction coating applied, such as a hardface coating. Therefore, any wear occurs to the coatings and not the components themselves.

Figure 10:
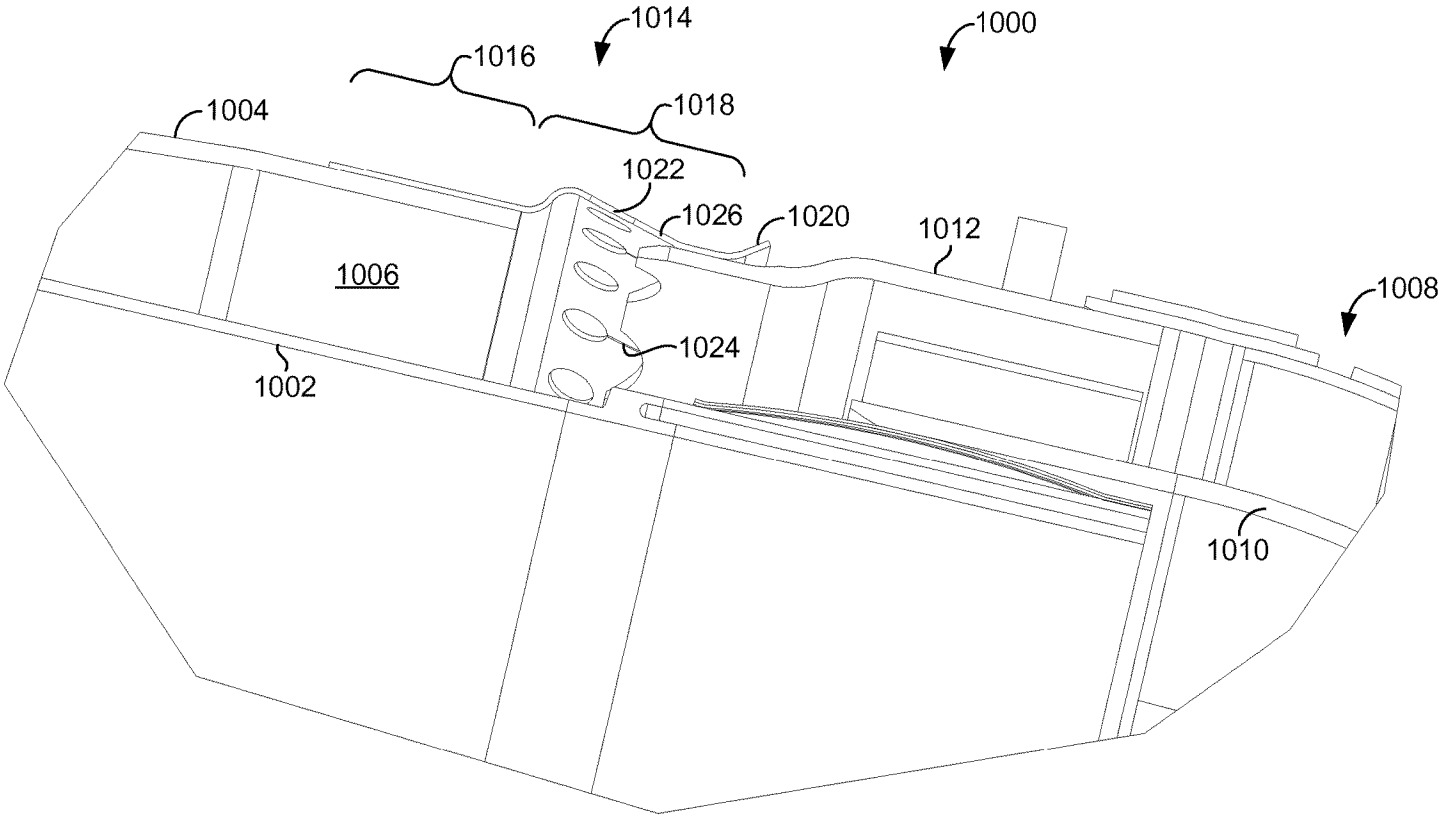
FIG. 10 is a cross section view of a portion of a combustion system in accordance with an alternate embodiment of the present invention.
Figure 11:
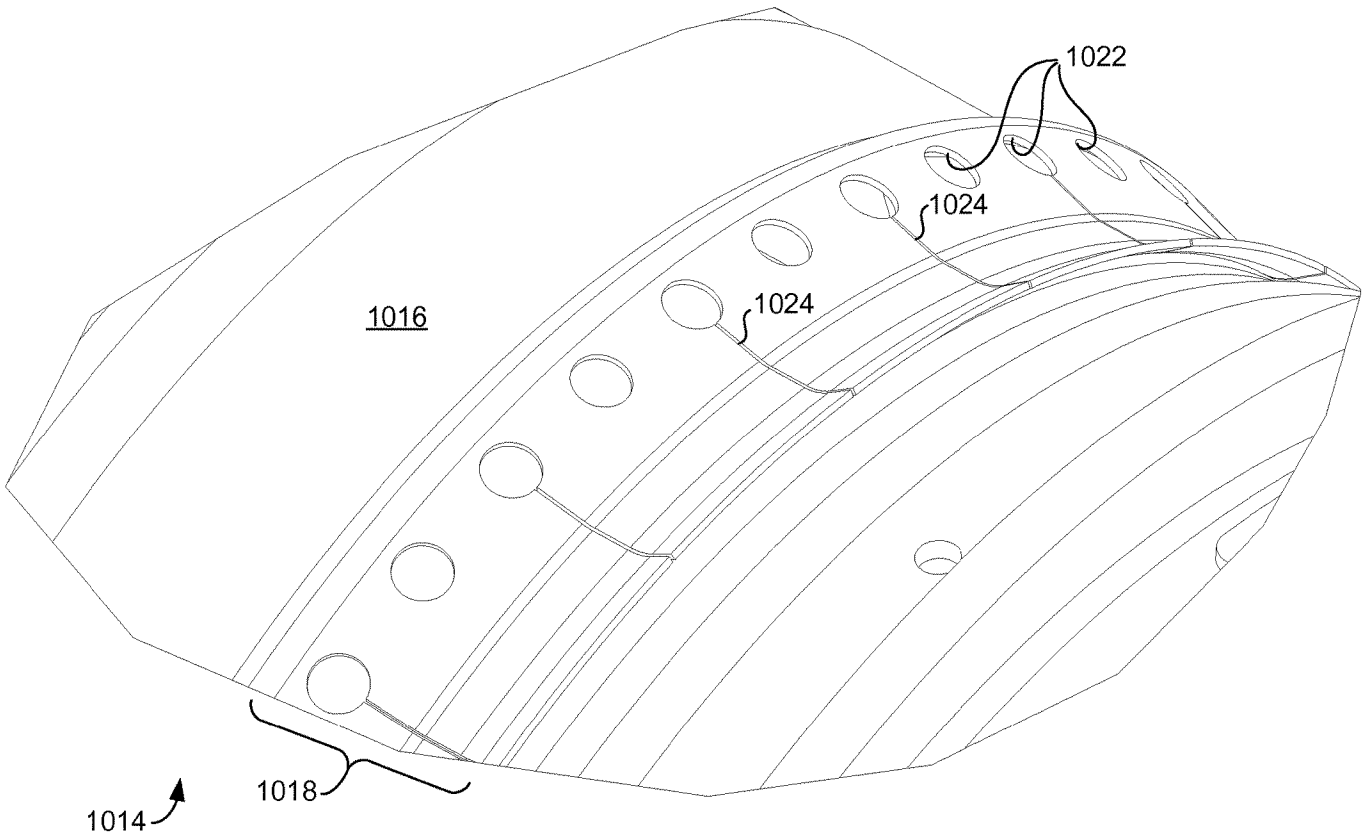
FIG. 11 is a perspective view of a portion of the combustion system of FIG. 10.

An alternate embodiment of the present invention is shown in FIGS. 10 and 11. That is, in an alternate embodiment of the present invention, a sealing system 1000 for a gas turbine combustor is provided. The sealing system 1000 comprises a combustion liner 1002, positioned along an axis (not shown) of the gas turbine combustor. A flow sleeve 1004 is positioned radially outward of the combustion liner 1002 forming an annular passage 1006 therebetween.

The sealing system 1000 also comprises a transition duct 1008 having a first wall 1010 and a second wall 1012 located radially outward of the first wall 1010. The transition duct 1008 engages the combustion liner 1002, where the aft end of the combustion liner 1002 is slidably engaged in the first wall 1010 of the transition duct 1008. The sealing system 1000 also comprises a compressible seal 1014 having a first annular portion 1016 and a second annular portion 1018. The compressible seal 1014 is secured to the flow sleeve 1004 along the first annular portion 1016. The means by which the compressible seal 1014 is secured can include welding or brazing. For welding, the compressible seal 1014 can be welded by resistance spot welds spaced about the perimeter of the seal, manual TIG welding, or other similar welding techniques.

As shown in FIG. 10, the second portion 1018 of the compressible seal 1014 is in contact with the second wall 1012 of the transition duct 1008. The second portion 1018 has a curved aft end 1020 where the curved shape helps to facilitate the engagement between the compressible seal 1014 and the second wall 1012 of the transition duct 1008. That is, the geometry of the second portion 1018 is sized such that the diameter of the second portion 1018 is slightly undersized compared to the diameter of the inlet of second wall 1012.

Referring now to FIGS. 10 and 11, the compressible seal 1014 also comprises a plurality of holes 1022. The plurality of holes 1022 provides a means for regulating flow of cooling fluid through the compressible seal 1014. The exact size and shape of the plurality of hole 1022 can vary depending on the desired cooling flow through the seal. However, for an embodiment of the present invention, the plurality of holes 1022 are circular in shape and range from approximately 0.100 to 0.500 inches in diameter.

As shown in FIGS. 10 and 11, in an embodiment of the present invention, the compressible seal 1014 further comprises a plurality of axial slots 1024. The axial slots 1024 extend from the aft end of the compressible seal 1014 forward to the plurality of holes 1022 and intersect the holes 1022. As shown in FIG. 10, the second annular portion 1018 comprises a curved aft end 1020 and a transition portion 1026. As discussed above, the transition portion 1026 and the curved aft end 1020 are sized and configured so as to ensure a constant pressure applied to the second wall 1012 of the transition duct 1008.

The plurality of holes 1022 and axial slots 1024 provide a way of directing cooling fluid, such as compressed air, to the passageway 1006. The holes 1022 are sized so as to supply a majority of the cooling fluid to the passageway 1006. However, the plurality of axial slots 1024 can also provide some cooling fluid depending on their final size when the flow sleeve 1004 is secured to the second wall 1012 of the transition duct 1008.

Figure 12:
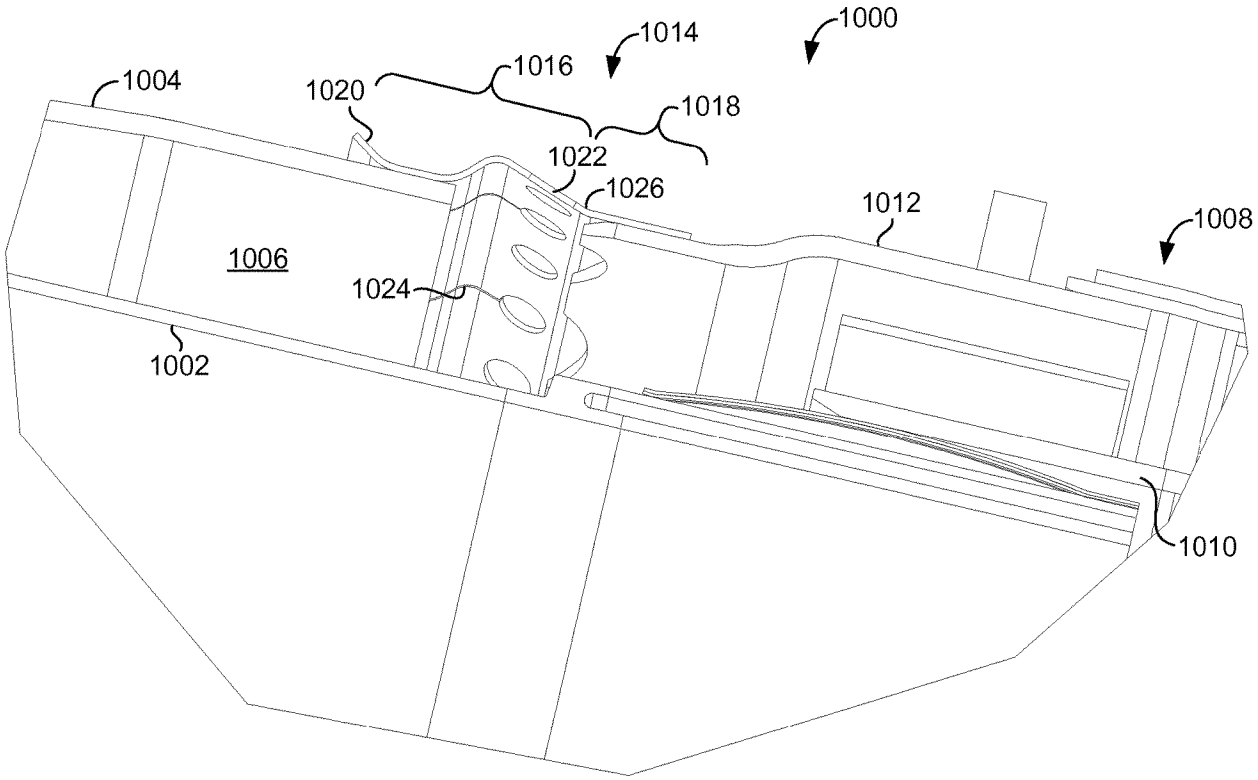
FIG. 12 is a cross section view of a portion of a combustion system in accordance with yet another alternate embodiment of the present invention.
Figure 13:
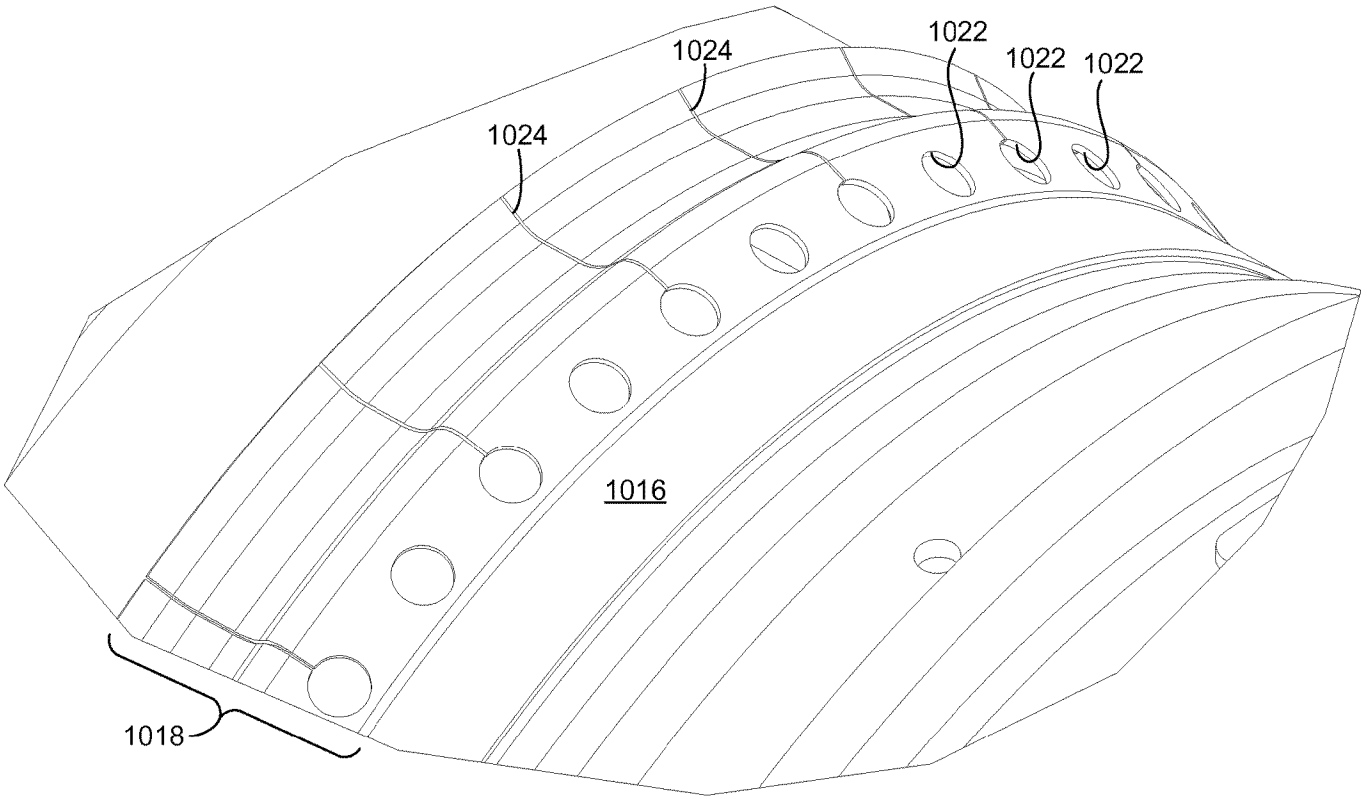
FIG. 13 is a perspective of a portion of the combustion system of FIG. 12.

Alternatively, the compressible seal 1014 may be oriented in an opposing direction, as shown in FIGS. 12 and 13. More specifically, the seal 1014 includes the same general features of the compressible seal shown in FIGS. 10 and 11, however, the compressible seal 1014 of FIGS. 12 and 13 is oriented opposite to that of the configuration in FIGS. 10 and 11. More specifically, the first annular portion 1016 is secured to the outer surface of the second wall 1012 of the transition duct 1008. The compressible seal 1014 then extends forward towards the flow sleeve 1004 where a second portion 1018 of the compressible seal 1014 contacts the flow sleeve wall proximate the curved aft end 1020. The compressible seal 1014 is secured to the second wall 1012 of the transition duct 1008 by a means such as brazing or welding.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A gas turbine combustor comprising:

a combustion liner positioned along an axis of the gas turbine combustor, the combustion liner having a forward end and an aft end;

a flow sleeve positioned radially outward of the combustion liner such that an annular passage between the combustion liner and the flow sleeve is formed, the annular passage being configured to direct compressed air to an inlet of the combustion liner positioned at the forward end of the combustion liner, the flow sleeve having a forward end and an aft end; and a compressible seal having a first annular portion, a second annular portion, and a transition portion, wherein the compressible seal is positioned between the combustion liner and the flow sleeve, wherein the compressible seal is configured to regulate a flow of the compressed air passing through the compressible seal and into the annular passage, wherein the compressible seal is fixedly secured to an annular ring of the combustion liner thereby restricting movement in an axial direction between the compressible seal and the combustion liner, the annular ring of the combustion liner extending from a position on the combustion liner proximate the aft end of the combustion liner to the aft end of the combustion liner, and wherein the second annular portion has an inner diameter and includes a plurality of axial slots such that the second annular portion is compressible from a free condition to a compressed condition when assembled into the gas turbine combustor, the inner diameter of the second annular portion when in the compressed condition being smaller than the inner diameter of the second annular portion when in the free condition, wherein the flow sleeve has an inlet ring with an outer diameter and an inner diameter, the inlet ring extending from a position on the flow sleeve proximate the aft end of the flow sleeve to the aft end of the flow sleeve, wherein the second annular portion of the compressible seal is positioned radially within, and in sliding contact with, the inner diameter of the flow sleeve inlet ring such that the second annular portion is in the compressed condition to form a compression fit between the compressible seal and the inlet ring.

2. The gas turbine combustor of claim 1, wherein the compressible seal is positioned such that the plurality of axial slots in the second annular portion of the compressible seal are proximate the inlet ring.

3. The gas turbine combustor of claim 1, wherein the flow of the compressed air is regulated through the compressible seal by a plurality of openings spaced about the transition portion of the compressible seal.

4. The gas turbine combustor of claim 3, wherein the plurality of openings provide a uniform flow of the compressed air to the combustion liner.

5. The gas turbine combustor of claim 1, wherein the compressible seal is welded to the annular ring of the combustion liner.

6. The gas turbine combustor of claim 1, wherein the compressible seal is brazed to the annular ring of the combustion liner.

7. A gas turbine combustor comprising:

a combustion liner positioned along an axis of the gas turbine combustor, the combustion liner having a forward end and an aft end;

a flow sleeve having a forward end and an aft end; and a seal, the seal comprising:

a first annular portion having a first diameter;

a second annular portion having a second diameter, wherein the second annular portion is radially outward of the first annular portion; and a transition portion extending between the first annular portion and the second annular portion, the transition portion having a plurality of openings for regulating a flow of a cooling fluid, wherein the first annular portion is fixedly secured to an annular ring of the combustion liner thereby restricting movement in an axial direction between the seal and the combustion liner, the annular ring of the combustion liner extending from a position on the combustion liner proximate the aft end of the combustion liner to the aft end of the combustion liner, wherein the flow sleeve is positioned radially outward of the combustion liner such that an annular passage between the combustion liner and the flow sleeve is formed, wherein the annular passage is configured to direct a portion of the flow of the cooling fluid to an inlet of the combustion liner positioned at the forward end of the combustion liner, and wherein the second annular portion includes a plurality of axial slots such that the second annular portion is compressible from a free condition to a compressed condition when assembled into the gas turbine combustor, the second diameter of the second annular portion when in the compressed condition being smaller than the second diameter of the second annular portion when in the free condition, wherein the flow sleeve has an inlet ring with an outer diameter and an inner diameter, the inlet ring extending from a position on the flow sleeve proximate the aft end of the flow sleeve to the aft end of the flow sleeve, wherein the second annular portion of the compressible seal is positioned radially within, and in sliding contact with, the inner diameter of the flow sleeve inlet ring such that the second annular portion is in the compressed condition to form a compression fit between the compressible seal and the inlet ring.

8. The gas turbine combustor of claim 7, wherein the plurality of openings are arranged in axially spaced rows about the seal.

9. The gas turbine combustor of claim 7, wherein the first annular portion, the second annular portion and the transition portion are formed from a single piece of sheet metal.

10. The gas turbine combustor of claim 7, wherein the plurality of openings in the transition portion are spaced in a uniform pattern about the transition portion.

11. The gas turbine combustor of claim 7, wherein the seal is configured to supply a predetermined amount of the flow of the cooling fluid towards a combustion liner aft end cooling channel.

12. The gas turbine combustor of claim 7, wherein the first annular portion is welded to the combustion liner.

13. The gas turbine combustor of claim 7, wherein the first annular portion is brazed to the combustion liner.

* * * * *